US009120129B2

(12) United States Patent
Boccabella

(10) Patent No.: US 9,120,129 B2
(45) Date of Patent: Sep. 1, 2015

(54) VIBRATING SCREEN MODULES

(71) Applicant: Joe Boccabella, Hamilton (CA)

(72) Inventor: Joe Boccabella, Hamilton (CA)

( * ) Notice: Subject to any disclaimer, the term of this patent is extended or adjusted under 35 U.S.C. 154(b) by 0 days.

(21) Appl. No.: 14/538,112

(22) Filed: Nov. 11, 2014

(65) Prior Publication Data

US 2015/0165483 A1 Jun. 18, 2015

Related U.S. Application Data

(60) Provisional application No. 61/917,636, filed on Dec. 18, 2013.

(51) Int. Cl.
*B07B 1/49* (2006.01)
*B07B 1/46* (2006.01)

(52) U.S. Cl.
CPC ..... *B07B 1/4645* (2013.01); *B07B 1/4627* (2013.01)

(58) Field of Classification Search
CPC ..... B07B 1/46; B07B 1/4609; B07B 1/4645
USPC ..... 209/405
See application file for complete search history.

(56) References Cited

U.S. PATENT DOCUMENTS

| | | | | |
|---|---|---|---|---|
| 5,266,194 | A * | 11/1993 | Chiodo | 210/232 |
| 5,816,413 | A * | 10/1998 | Boccabella et al. | 209/399 |
| 5,950,841 | A * | 9/1999 | Knox et al. | 209/315 |
| 8,127,932 | B2 * | 3/2012 | Trench et al. | 209/405 |
| 2014/0251894 | A1 * | 9/2014 | Larson et al. | 210/330 |

* cited by examiner

*Primary Examiner* — Terrell Matthews

(57) ABSTRACT

The present invention is a circular screen panel for a vibratory screen separator including a plurality of pie shaped screen modules assembled together to form a circular screen panel. Each screen panel includes a module frame which includes two radial arms and a curved portion, the radial arms connected together at one end and connected to the curved portion at the other end. Each of the radial arms includes a horizontal and vertical position, the horizontal portion for receiving the screen thereon. The vertical portion includes a channel for receiving a portion of a gasket such that abutting surfaces of the vertical portion of the L shaped member of adjacent screen modules make contact in an assembled position.

7 Claims, 5 Drawing Sheets

102

106

110
106
120
108
152
106
102
112

VIBRATING SCREEN MODULES

The applicant claims priority from regularly filed U.S. provisional application 61/917,636 titled: VIBRATING SCREEN MODULES filed by Joe Boccabella on Dec. 18, 2013.

FIELD OF THE INVENTION

The present invention relates to vibrating screen separators and in particular relates to circular vibrating screen separators. The present concept is a screen module used to assemble an entire screen panel.

BACKGROUND OF THE INVENTION

Vibrating screen separators are used in industry for a variety of undertakings. Vibrating screen separators are used to process dry materials and liquid/solid slurries. Each vibrating screen separator typically functions by first introducing a flow of material to a porous element such as a screen or filter usually of a woven wire mesh or a porous membrane. The flow of material is separated into two streams one containing material that passes through the porous element the other containing material that is too large to pass through the porous element. A drive mechanism may be operatively coupled with a housing to produce a vibrating motion that serves to put the material on the porous element in motion until it either passes through or is pushed off the element at the periphery thereof.

Vibrating screen separators employ screens of rectangular and also of circular forms with screen elements, tensioned frames or with hooks tensioned onto the separator itself.

The screen elements also referred to as screen panels range greatly in porosity and can be of a single element or of laminates. The separator frames are usually vibratory and are normally supported by a variety of elastic elements such as springs, bushings and/or links. During the use of vibrating screen separators screen panels eventually will fail due to normal wear and tear. In the case of a failure with screen panels normally the entire panel must be replaced in order to effect the repair.

There is a need for a modular screen panel system wherein individual screen modules can be replaced rather than the entire screen panel when a failure occurs.

BRIEF DESCRIPTION OF THE DRAWINGS

The present concept will now be described by way of example only with reference to the following drawings in which.

DETAILED DESCRIPTION OF THE PREFERRED EMBODIMENT

The present concept a screen panel 100 is assembled together from four individual screen modules 102 which make up the entire screen panel which has an outer diameter 112 and an outer gasket 114 which runs around the entire outer periphery of screen panel 100.

Figures 2, 3:
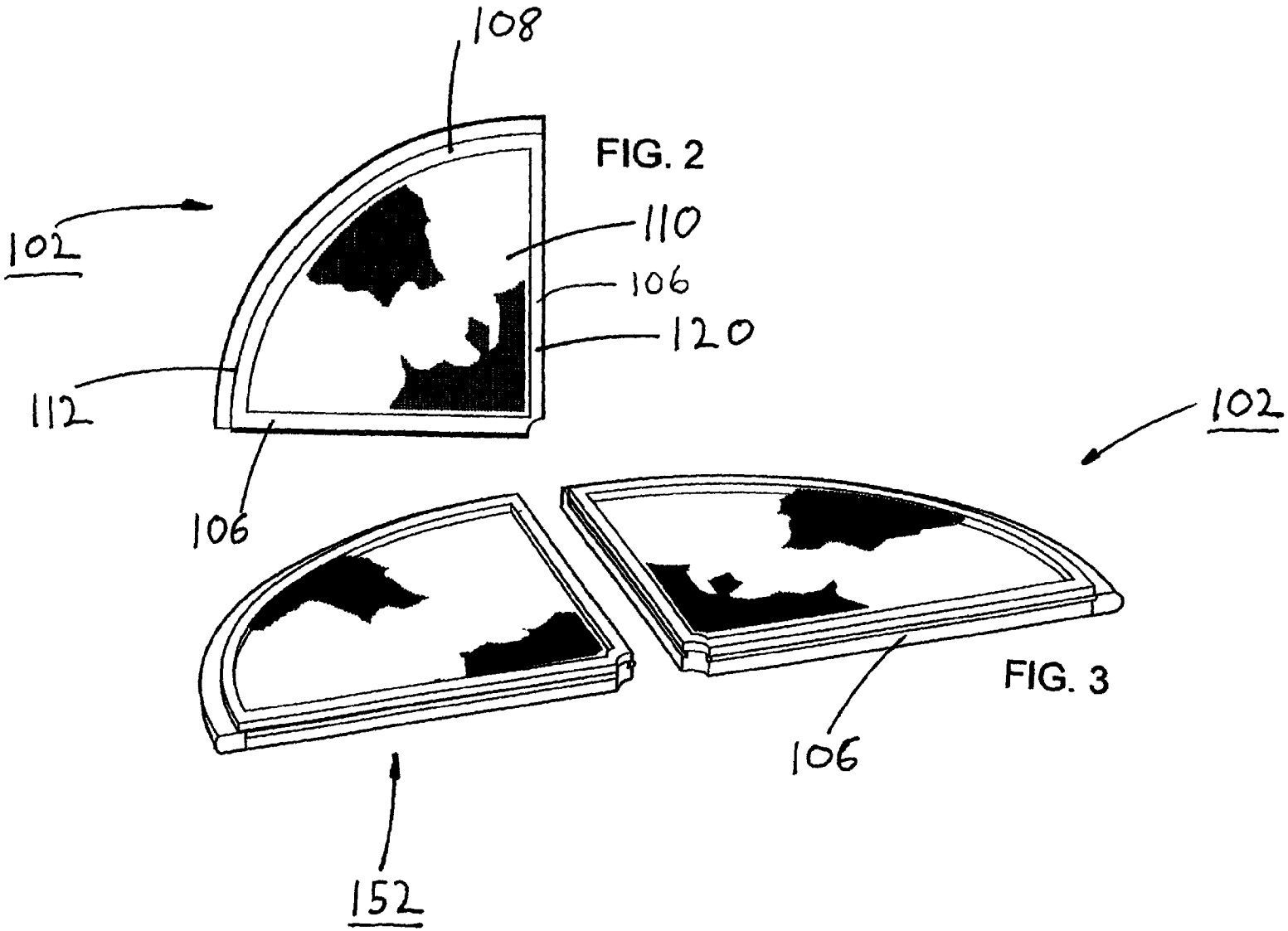
FIG. 2 is a top plan view of a screen module.
FIG. 3 is a schematic perspective view of two screen modules.

Referring now also to FIGS. 2 and 3 each of the individual screen modules include two radial arms 106 and a curved portion 108 which makes up the module frame 120. Each screen module 102 includes a screen 110 such that screen panel 100 is assembled from four separate screen modules each having its own individual and separate screen 110.

The screen modules 1 and 2 shown in FIGS. 2 and 3 are in a disassembled position 152 meaning that the screen modules 102 are not assembled together to form screen panel 100.

Figure 1:
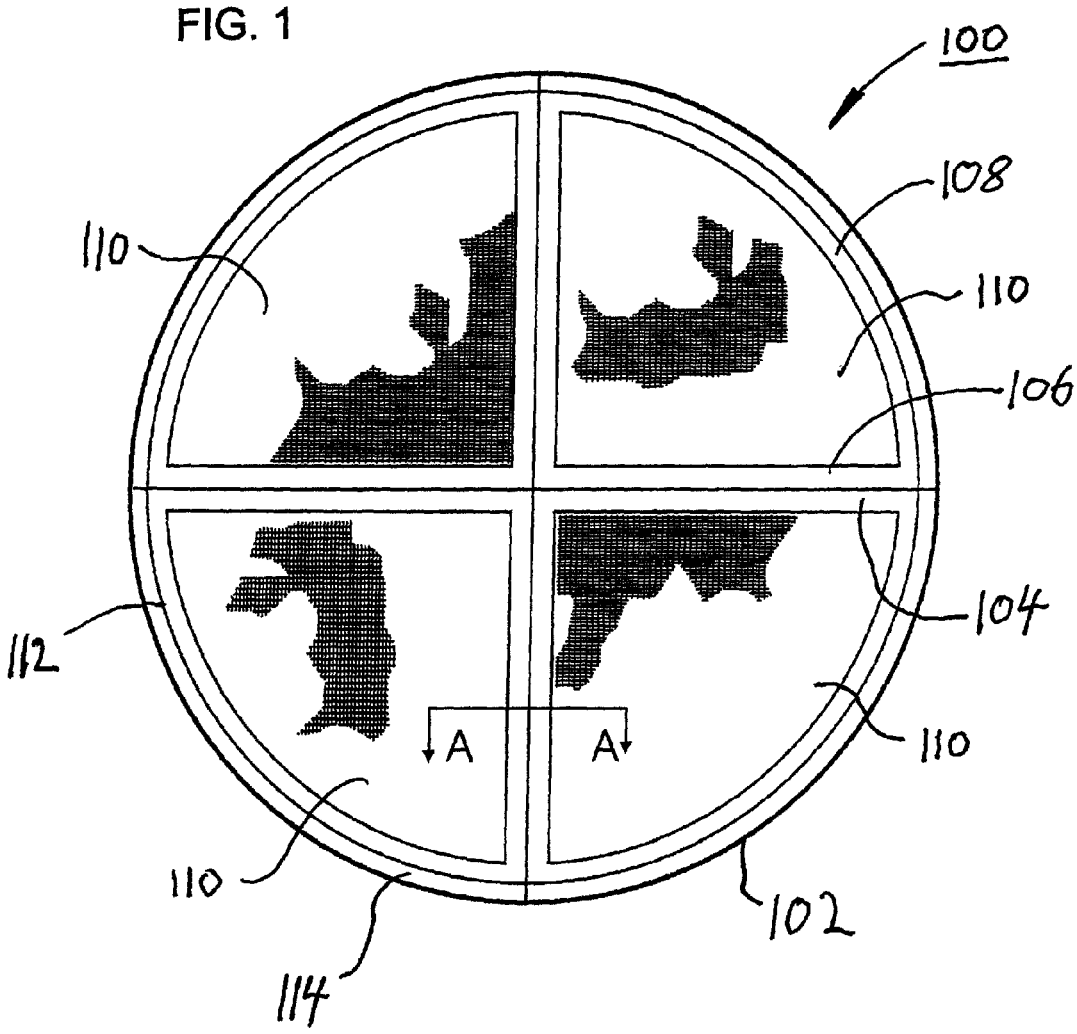
FIG. 1 is a top plan view of the screen panel made up of four screen modules.
Figure 4:
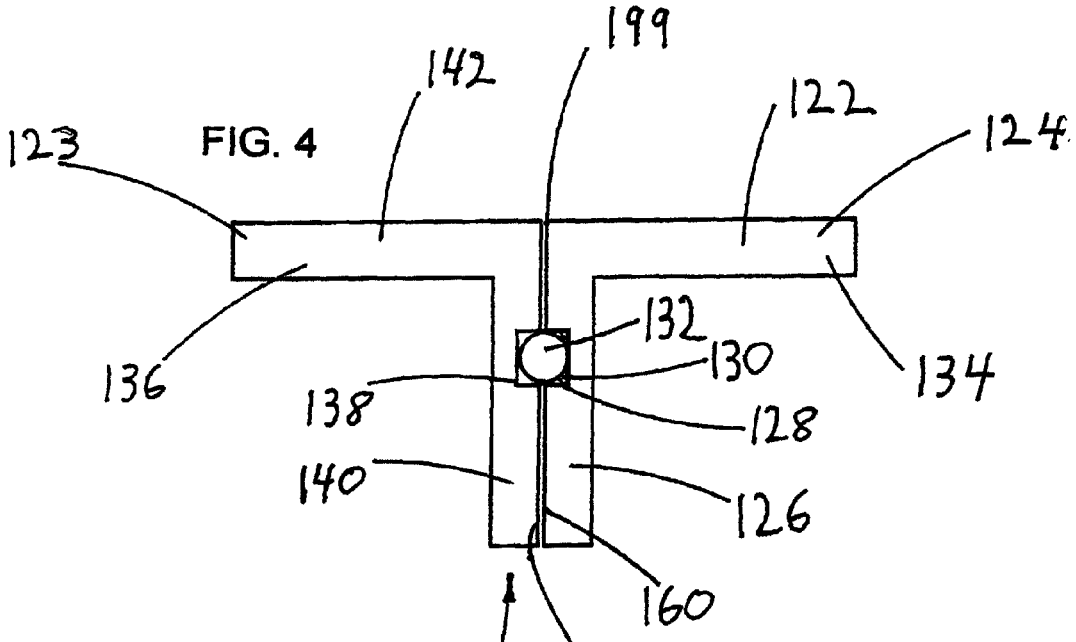
FIG. 4 is a cross sectional view taken along the line AA of FIG. 1
Figure 5:
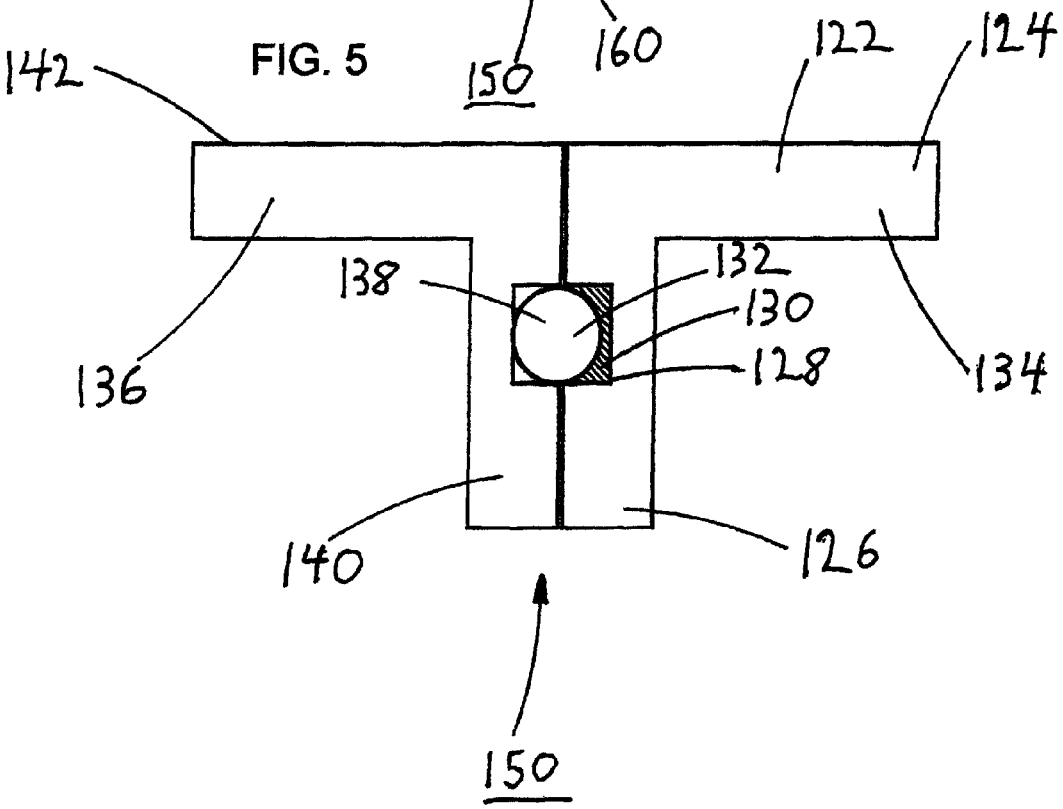
FIG. 5 is a cross sectional schematic view taken along line AA of an alternate embodiment of FIG. 1.

Referring now to FIGS. 4 and 5 which is a cross sectional view taken along line AA of FIG. 1 shown both in schematic fashion in both FIGS. 4 and 5 with the only differences in FIGS. 4 and 5 being the size of the screen module frame 120. In all other aspects the structure is essentially equivalent except for size.

FIG. 4 for example shows two radial arms joined together into an assembled position 150 namely right radial arm 134 abuts left radial arm 136 along the abutting surfaces 160 of each of the vertical portions 126 and 140 of each of the radial arms 134 and 136.

In particular right radial arm 134 consists of an L shaped member 122 which includes a vertical portion 126 and a horizontal portion 124. Vertical portion 126 further includes a right channel 128 which has mounted therein a gasket 132 being held in place with adhesive 130.

Similarly left radial arm 136 is made up of an L-shaped member 123 which is simply the mirror image of L-shaped member 122. L-shaped member 123 includes a horizontal portion 142, a vertical portion 140 which has defined therein a left channel 138 for receiving the gasket 132 therein as depicted. The abutting surfaces 160 of each of the vertical portion 126 and 140 come into close proximity and contact in the assembled position 150.

FIG. 5 shows similar structure only on a larger scale.

Figure 6:
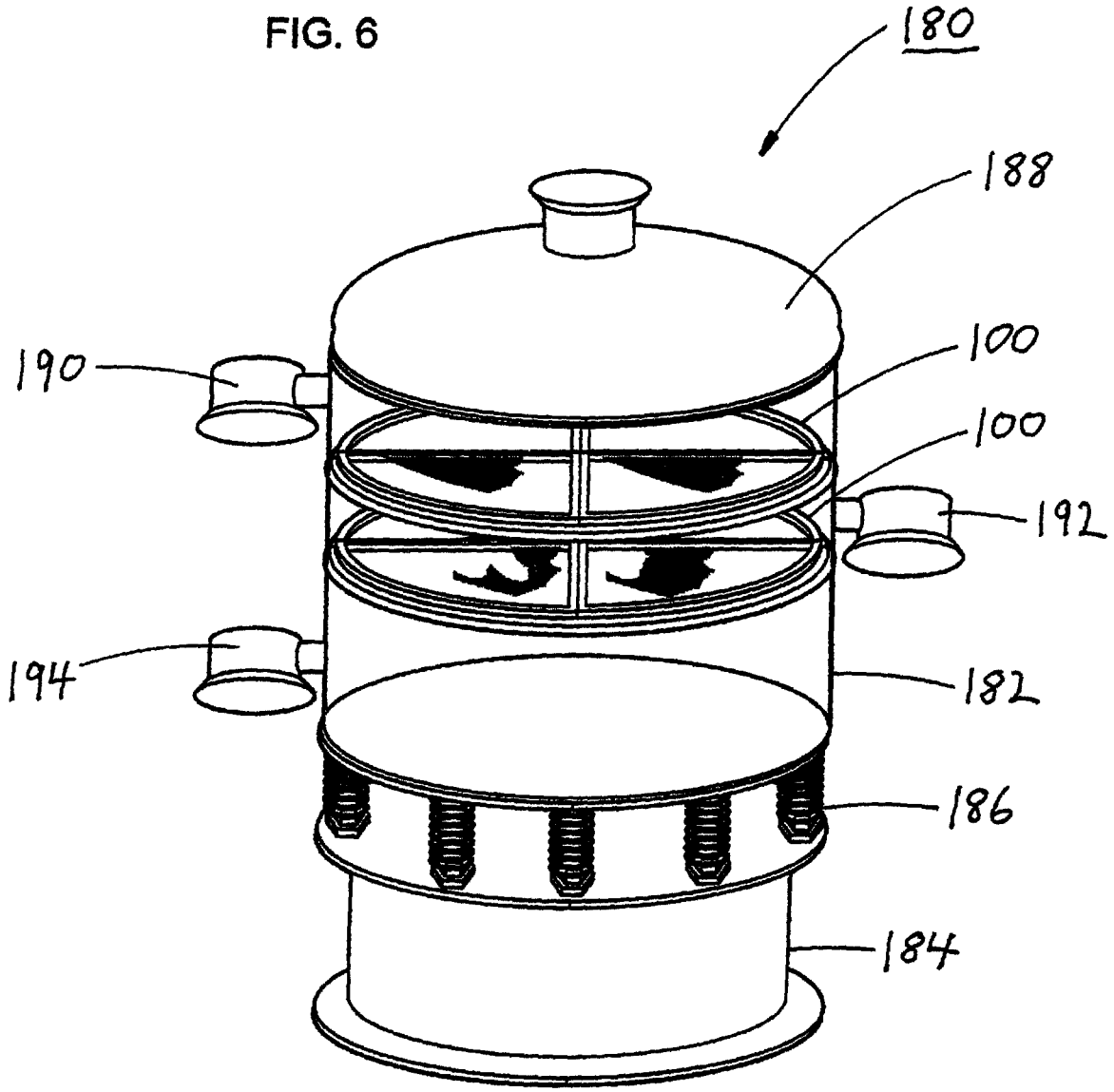
FIG. 6 is a schematic perspective view of a circular vibrating screen separator showing screen panels deployed therein.

Referring now to FIG. 6 which is schematic of an entire circular vibrating screen separator shown as 180 which includes a housing 182 mounted onto a base 184 using springs 186. Cylindrical housing 182 as mounted therein circular screen panels 100 at various levels each of which have a corresponding over outlet 190 and overs outlet 192 and also a throughs discharge 194. Housing 182 also includes a top 188. Screen 100 includes a plurality of openings of a predetermined size. The material deposited onto the screen 100 include particles having a size larger than the openings in the screen 100 such that these particles do not fall through screen 100 so long as there are no break in the screen 100. Particles that do not fall through the screen are called overs. The material is deposited on the screen 100 may also include particles having a size smaller than the openings of screen 100. These particles that fall through the screen are often called throughs. Above the screen 100 is an overs outlet 190 and also 192 on the second screen panel 100. There is also a throughs discharge 194 at the bottom of housing 182 of circular vibrating screen separator 180.

Figure 7:
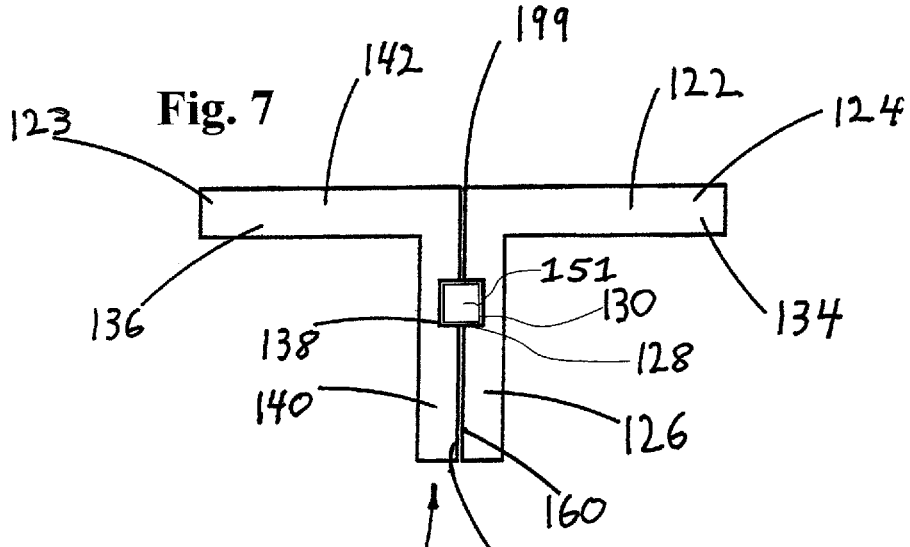
FIG. 7 is a cross sectional view taken along the line AA if FIG. 1 showing an alternate embodiment to that shown in FIGS. 4 and 5.
Figure 8:
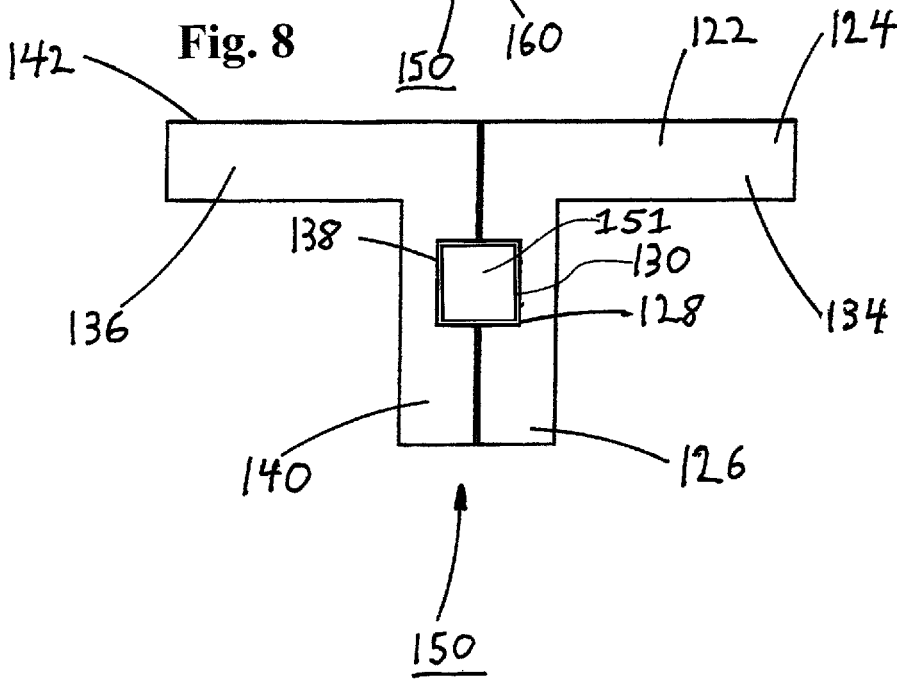
FIG. 8 is a cross sectional schematic view taken along line AA as an alternate embodiment of FIG. 7.

Referring now to FIGS. 7 and 8 which show a cross sectional view taken along line AA of FIG. 1 shown both in schematic fashion in both FIGS. 7 & 8 with the only difference being the size of the screen module frame 120. Note that all other aspects to structures are essentially equivalent except for size.

FIG. 7 for example shows two radial arms joined together into an assembled position 150 namely radial arm 134 abuts radial arm 136 along the abutting surfaces 160 of each of the vertical portions 126 and 140 of each of the radial arms 134 and 136.

In particular radial arm 134 consists of an L shaped member 122 which includes a vertical portion 126 and a horizontal portion 124. Vertical portion 126 further includes a right channel 128 which has mounted therein a gasket 151 being held in place with either an adhesive not shown or simply by the pressure applied by the coming together of vertical portion 126 and vertical portion 140.

Similarly left arm 136 is made up of an L shaped member 123 which is simply the mirror image of an L shaped member 122. L shaped member 123 includes a horizontal portion 142, a vertical portion 140 which has defined therein a left channel 138 for receiving the gasket 151 therein as depicted. The abutting surfaces 160 of each of the vertical portions 126 and 140 coming into abutting contact with each other in the assembled position 150.

FIG. 8 shows similar structure only on a larger scale.

In Use

The user will note that there are four screens 110 which make up a screen panel 100. Each of these screens 110 are individual and independently mounted onto individual screen modules 102. One can see that in the event of a failure of any one of the four screens 110 only one of the screen modules 102 needs to be replaced rather than the entire screen panel 100. In this way one is only replacing ¼ of the screen rather than the entire screen panel.

The connection mechanism at joint 199 is depicted in 4 and 5 prevents the materials in the screen from passing through screen panel 100 at the joint 199 due to the presence of gasket 132 and the left and right channels defined in each of the vertical portions 126 and 140 respectively. In addition the vertical portions make contact at the abutting surfaces 160 of each of the L-shaped members 122 and 123.

The reader will note that screen panel 100 could be manufactured of any number of individual screen modules. The example provided in the specification shows 4 screen modules making up the screen panel however it could very well be 2, 3, 4, 5, 6 etc., making up screen panel 100.

The size of the screen module will depend on the overall size of the screen panel and the frequency of breaks occurring in the screen and also the mesh size of the screen and the material being screened. There are many factors which determine the number of screen modules that will be used to assemble a single screen panel.

The connection mechanism at joint 199 is depicted in FIGS. 7 and 8 and prevent the materials in the screen from passing through screen panel 100 at the joint 199 due to the presence of gasket 151 disposed in the left and right channels 138 and 128 respectively in each of the vertical portions 126 and 140 respectively. In addition to vertical portions 126 and 140 make abutting contacting at the abutting surfaces 160 of each of the L shaped members 122 and 123 further preventing materials that are on the screen from passing through screen panel 100 at the joint 199.

It should be apparent to persons skilled in the arts that various modifications and adaptation of this structure described above are possible without departure from the spirit of the invention the scope of which defined in the appended claim.

I claim:

1. A circular screen panel for a vibratory screen separator comprising:

a) a plurality of pie shaped screen modules assembled together to form a circular screen panel, b) each screen panel includes a module frame which includes two radial arms and a curved portion, the radial arms connected together at one end and connected to the curved portion at the other end, c) each radial arm including a horizontal portion and a vertical portion, the horizontal portion for receiving the screen thereon, d) wherein the vertical portion includes a channel for receiving therein a portion of a gasket such that abutting surfaces of the vertical portion of an L shaped member of adjacent screen modules make contact in an assembled position.

2. The circular screen panel claimed in claim 1 wherein the module frame including a center cut out where the two radial arms connect together.

3. The circular screen panel claimed in claim 2 wherein the cut out being semi-circular such that when all the screen modules are mounted together the center cut outs define a central circular opening in the circular screen panel.

4. The circular screen panel claimed ion claim 1 wherein each radial arm is an L shaped member with a horizontal portion and a vertical portion.

5. The circular screen panel claimed in claim 4 wherein the gasket being an o ring gasket of circular cross section and held in place with an adhesive applied to at least one of the channels.

6. The circular screen panel claimed in claim 4 wherein the gasket being a square cross section.

7. The circular shaped screen panel claimed in claim 4 wherein each vertical portion including a three sided channel with defines a square cross section when the L shaped cross members are in the assembled position.

* * * * *